US010986704B2

(12) United States Patent
Sterz et al.

(10) Patent No.: US 10,986,704 B2
(45) Date of Patent: Apr. 20, 2021

(54) HOUSEHOLD COOKING APPLIANCE

(71) Applicant: BSH Hausgeräte GmbH, Munich (DE)

(72) Inventors: Sebastian Sterz, Großaitingen (DE); Markus Kuchler, Gstadt am Chiemsee (DE); Wojciech Gwarek, Warsaw (PL); Kerstin Rigorth, Mühldorf (DE)

(73) Assignee: BSH Hausgeräte GmbH, Munich (DE)

( * ) Notice: Subject to any disclaimer, the term of this patent is extended or adjusted under 35 U.S.C. 154(b) by 172 days.

(21) Appl. No.: 16/335,274

(22) PCT Filed: Oct. 26, 2017

(86) PCT No.: PCT/EP2017/077445

§ 371 (c)(1),
(2) Date: Mar. 21, 2019

(87) PCT Pub. No.: WO2018/083006

PCT Pub. Date: May 11, 2018

(65) Prior Publication Data

US 2019/0289683 A1 Sep. 19, 2019

(30) Foreign Application Priority Data

Nov. 2, 2016 (DE) ..... 10 2016 221 447.0

(51) Int. Cl.
*H05B 6/70* (2006.01)

(52) U.S. Cl.
CPC ..... *H05B 6/702* (2013.01)

(58) Field of Classification Search
CPC ..... H05B 6/6402; H05B 6/6408; H05B 6/70; H05B 6/702; H05B 6/705; H05B 6/707;
(Continued)

(56) References Cited

U.S. PATENT DOCUMENTS 4,006,339 A * 2/1977 Maurer ..... H05B 6/705 219/697
6,034,362 A * 3/2000 Alton ..... H05B 6/688 219/746

(Continued)

FOREIGN PATENT DOCUMENTS

CN 1262413 A 8/2000
CN 102960060 A 3/2013

(Continued)

OTHER PUBLICATIONS

National Search Report DE 10 2016 221 447.0 dated Jul. 26, 2017.

(Continued)

*Primary Examiner* — Hung D Nguyen
(74) *Attorney, Agent, or Firm* — Michael E. Tscupp; Andre Pallapies; Brandon G. Braun

(57) ABSTRACT

A household cooking appliance includes a cooking space and a microwave apparatus which is configured to feed microwaves into the cooking space. The microwave apparatus includes a feed chamber arranged outside of the cooking space and configured to open into the cooking space through an emission opening which is excitable by the microwaves, and a microwave line projecting into the feed chamber and connected galvanically to an electrically conductive wall region of the feed chamber which wall region restricts the emission opening. The feed chamber defines a chamber which is non-resonant for the microwaves.

14 Claims, 3 Drawing Sheets

(58) Field of Classification Search
CPC . H05B 6/745; H05B 6/78; H05B 6/80; H05B 6/806
USPC ..... 219/678, 690, 692, 695, 696, 697, 746, 219/761
See application file for complete search history.

(56) References Cited

U.S. PATENT DOCUMENTS

| | | | | |
|---|---|---|---|---|
| 7,015,441 | B2 * | 3/2006 | Fagrell | B01J 19/126 219/690 |
| 2004/0069776 | A1 | 4/2004 | Fagrell et al. | |
| 2004/0188429 | A1 | 9/2004 | Carlsson et al. | |
| 2010/0237067 | A1 | 9/2010 | Carlsson et al. | |
| 2012/0067873 | A1 * | 3/2012 | Mihara | H05B 6/688 219/704 |
| 2012/0152938 | A1 * | 6/2012 | Nordh | H05B 6/705 219/702 |
| 2014/0166645 | A1 | 6/2014 | Hosokawa et al. | |
| 2014/0305933 | A1 | 10/2014 | Liang et al. | |
| 2015/0021316 | A1 * | 1/2015 | Fagrell | B01J 19/126 219/687 |
| 2015/0041458 | A1 * | 2/2015 | Muto | H05B 6/808 219/709 |
| 2015/0245424 | A1 * | 8/2015 | Brill | H01Q 1/36 219/748 |
| 2017/0164429 | A1 | 6/2017 | Madege et al. | |
| 2018/0343713 | A1 * | 11/2018 | Swiergon | H05B 6/80 |
| 2018/0359822 | A1 * | 12/2018 | Mazzon | H05B 6/70 |

FOREIGN PATENT DOCUMENTS

| | | | |
|---|---|---|---|
| DE | 102011077172 | A1 | 12/2012 |
| EP | 2187701 | A1 | 5/2010 |
| EP | 20187699 | A1 | 5/2010 |
| WO | 9835533 | A1 | 8/1998 |

OTHER PUBLICATIONS

International Search Report PCT/EP2017/077445 dated Jan. 15, 2018.
National Search Report CN 201780067941.9 dated Dec. 2, 2020.

* cited by examiner

HOUSEHOLD COOKING APPLIANCE

CROSS-REFERENCES TO RELATED APPLICATIONS

This application is the U.S. National Stage of International Application No. PCT/EP2017/077445, filed Oct. 26, 2017, which designated the United States and has been published as International Publication No. WO 2018/083006 A1 and which claims the priority of German Patent Application, Serial No. 10 2016 221 447.0, filed Nov. 2, 2016, 2014, pursuant to 35 U.S.C. 119(a)-(d).

BACKGROUND OF THE INVENTION

The invention relates to a household cooking appliance with a cooking space and a microwave apparatus for feeding microwaves into the cooking space, wherein the microwave apparatus has a feed chamber arranged outside of the cooking space, a microwave line projecting into the feed chamber and the feed chamber opening into the cooking space by means of at least one opening. The invention can be applied particularly advantageously to microwave cooking appliances.

US 2004/0188429 A1 discloses a distributed microwave system, which comprises an individual microwave source, which can be used to power apparatuses by means of microwaves. The microwave source is arranged remote from the apparatuses and is connected herewith by means of a microwave line.

US 2014/305933 A1 discloses a semiconductor microwave oven and an associated microwave feed structure. The microwave feed structure contains a chamber body with a door, a semiconductor microwave power source and a microwave feed arrangement, which is connected between the semiconductor power source and the chamber body and is configured to feed the microwaves generated by the semiconductor power source into the chamber body and to convert from a first microwave mode, which is output by the semiconductor power source, into a second microwave mode, which is adjusted to a microwave heating.

EP 2 187 699 A1 discloses a cooking appliance, comprising an interior space, which comprises at least one cooking space, and comprising at least one microwave control structure for guiding microwaves from at least one microwave source as far as at least an opening in a wall or wall part of the interior space, wherein the microwave control structure has an exterior electrically conducting and fixed wall and at least one element for emitting microwaves into the interior space, the microwave control structure comprises a first section with a first cross-sectional shape of its exterior electrically conducting wall and a second section with a second cross-sectional shape, which is essentially round, in particular circular, and differs from the first cross-sectional shape and the element is arranged in the interior space at the one end of the second section.

EP 2 187 701 A1 discloses an apparatus for feeding microwaves into an interior space of a cooking appliance, comprising: at least one resonator space, at least two antennas assigned to the resonator space, each with the radiation characteristics of a dipole antenna, in which no microwave power is essentially transmitted along an antenna axis, and means for supplying microwaves of the wavelength $\lambda$ to the antennas, wherein the two antennas transmit polarized radiation orthogonally to one another, each antenna is attached to a wall of the resonator chamber, and the antenna axes are aligned in directions which are essentially at right angles to one another, as well as a cooking appliance and a method for feeding microwaves into an interior space of a cooking appliance.

BRIEF SUMMARY OF THE INVENTION

The object of the present invention is to overcome the disadvantages of the prior art at least partially and in particular to provide the option of feeding microwaves into a cooking space of a cooking appliance in a broadband-emitting and particularly compact and easily implementable manner.

This object is achieved according to the features of the independent claims. Preferred embodiments can be inferred in particular from the dependent claims.

The object is achieved by a cooking appliance with a cooking space and a microwave apparatus for feeding microwaves into the cooking space, wherein the microwave apparatus has a chamber (referred to below without restricting generality as "feed chamber") arranged outside of the cooking space, a microwave line projecting into the feed chamber and the feed chamber opening into the cooking space by means of at least one opening. The microwave line is connected galvanically to an electrically conductive wall region of the feed chamber which restricts the opening. The at least one opening (referred to below without restricting generality as "emission opening") can be resonantly excited by the microwaves. The feed chamber is a non-resonant chamber for the microwaves.

This cooking appliance is advantageous in that it can be executed in a particularly compact manner, since the feed chamber is a non-resonant chamber and therefore, contrary to a resonator space, does not need to adhere to dimensions for fulfilling resonance conditions of the microwaves. Moreover, this cooking appliance can be implemented robustly and easily from the manufacturing standpoint.

This cooking appliance makes use of the fact that the emission opening can be directly resonantly excited using the microwave energy supplied via the microwave supply line and then itself emits microwave radiation into the cooking space ("self-resonating opening"). Since the opening oscillates resonantly and can effectively emit into the cooking space, a good broadband capacity is produced. The resonantly excited emission opening can in this sense also be considered to be a microwave line supplied directly by the microwave supply line. An indirect connection or coupling via a microwave resonance excited in the chamber is not required. The present feed chamber is only required to guide the microwave supply line to a suitable wall region of the feed chamber. The feed chamber can take over the function of a housing with electrical control effect, in particular, in order to receive or realize at least one emission opening mechanically but has no or only a minimal influence on the quality. The feed chamber therefore does not need to be designed for a high field excitation and field amplification and can be embodied to be particularly flat, for example. The properties of the emission opening (e.g. its intrinsic or resonance frequency) are determined significantly by its shape and/or size. The small installation height of the feed chamber can in particular be used to arrange the feed chamber, without noticeably restricting a volume of the cooking space, on a wall of the cooking space. A positionability of the feed chamber is also improved as a result. The feed chamber can be arranged e.g. on a ceiling, on a base, on left and right side walls, on a rear wall etc. of the cooking space.

A further development is that the cooking appliance is a household appliance, in particular a kitchen appliance. The cooking appliance can be a pure microwave appliance ("microwave oven"). The cooking appliance can be a combination of a heatable oven and a microwave appliance, e.g. a baking oven with a microwave functionality. If the cooking appliance has such an oven functionality, the cooking space can also be referred to as oven space. The cooking space typically has a front loading opening for loading the cooking space, which can be closed by means of a door.

The microwave apparatus can have a microwave generation unit, e.g. a magnetron. The microwave line is embodied and arranged to route microwaves or microwave energy generated by the microwave apparatus to the wall region of the feed chamber restricting the opening. The microwaves can have a frequency of 2.45 GHz.

The part of the microwave line projecting into the feed chamber can emit microwaves into the feed chamber and thus also act as an antenna.

In one further development the wall region restricting the emission opening or even the entire housing of the feed chamber is embodied to be electrically conductive. This allows for a particularly effective control effect for the microwaves. Moreover, a shielding for microwaves emitted by the microwave supply line into the feed chamber is provided. For instance, the wall region restricting the emission opening or the entire housing can be made of metal, e.g. sheet metal, in particular sheet steel.

In a further development, the feed chamber is fastened to the housing by means of welding, screwing, clinching (tox clinching) etc.

In one embodiment, the at least one emission opening is embodied with a slot shape ("self-resonating slot"). As a result, a particularly high feed effectiveness is achieved. The at least one emission opening can then also be considered to be a slot antenna, which however does not couple microwaves out of the feed chamber, but is instead supplied directly using the microwave supply line.

Another embodiment is that at least one resonantly excitable emission opening is an arched opening, in particular an arched slot. In a further development, the arched emission opening is a u-shaped opening, in particular a u-shaped slot. This embodiment is advantageous in that the dimensions of the emission opening can be reduced.

In another embodiment, at least one resonantly excitable emission opening is a straight opening, in particular a straight slot. This allows for a particularly simple introduction and design.

In a further embodiment, the at least one emission opening has at least two emission openings. A particularly high microwave power can be output into the cooking space. This also achieves a particularly good distribution of the microwaves propagating in the cooking space.

In another embodiment, at least two emission openings are separated from one another by means of a web and the microwave line contacts the web galvanically. This allows for particularly minimal losses and a particularly high quality, in particular in the sense of minimal reflection values S11. This arrangement can also be understood to mean a single emission opening which is subdivided by at least one web into partial emission openings which can be excited resonantly in each case.

In the case of several slot-type openings, these can be arranged at any angle relative to one another, e.g. in parallel or rotated about 90°. A twisted or non-parallel arrangement of the openings is advantageous in that a mutual influence of the microwave feeds into the cooking space can be kept minimal since microwaves with a different polarization can then be fed into the cooking space.

In a further embodiment, the microwave line is an inner conductor of a coaxial microwave line, in particular an inner conductor or central conductor of a microwave coaxial cable. The coaxial microwave line has the advantage of a cost-effective and robust line. Moreover, such an inner conductor can be easily attached galvanically to a desired wall section, e.g. by means of caulking, latching, screwing, welding etc. The inner conductor of the coaxial supply line can act in the interior of the feed chamber as an antenna. The length of the inner conductor can vary depending on the shape and/or size of the feed chamber used. In one development, the outer conductor or the shielding of the coaxial microwave line ends outside of the interior of the feed chamber, the outer conductor therefore does not project into the interior of the chamber. In another development, insulation of the coaxial microwave line ends outside of the interior space of the feed chamber, the insulation therefore does not project into the interior of the chamber. In the event that the microwave line is a microwave coaxial cable, this can be soldered, staked, screwed etc., in particular directly ("semi-rigid").

In another embodiment, the microwave line contacts a wall section facing the cooking space galvanically, in particular close to the emission opening. A particularly minimal distance from the at least one opening can therefore be achieved.

Moreover, in one embodiment, the microwave line traverses at least one resonantly excitable emission opening. This allows a particularly high quality to be achieved.

Moreover, in one embodiment, the microwave line contacts a wall section not facing the cooking space galvanically. This wall section can be a chamber wall facing away from the at least one opening. If a chamber wall facing the cooking space is referred to as a front wall, the far chamber wall represents a rear wall. The inner conductor can be arched here so that it runs away from the emission opening. A distance between these two chamber walls can also be referred to as chamber height.

In one development, the microwave line runs at right angles on the wall region to be contacted. It is advantageous for a particularly space-saving arrangement in the cooking appliance if the microwave line, in particular the inner conductor, has a right-angled course in the feed chamber.

The housing of the feed chamber can have essentially any shape, e.g. rectangular, be flattened or beveled or round at least in sections.

In another embodiment, the feed chamber has a front wall facing the cooking space, in which the at least one resonantly excitable emission opening is introduced, the front wall rests externally on a cooking space wall and the cooking space wall has at least one opening which is at least flush with the emission opening of the feed chamber. This allows for the finished feed chamber to manufactured before being inserted into the cooking appliance. The feed chamber can advantageously be manufactured particularly easily in a microwave-tight manner. The cooking appliance can therefore be embodied partially in two layers on the cooking space wall to which the feed chamber is attached. Here one position represents the front wall of the feed chamber which has the emission opening and another position represents a cooking space wall. The fact that the cooking space wall has an opening which is at least flush with the emission opening can comprise that these two openings are precisely flush (in other words in particular has the same overlying edges) or that the opening of the cooking space wall is larger than the emission opening. The cooking space wall therefore does not cover the emission opening, so that microwaves can pass through the cooking space wall unobstructed.

Alternatively, or in addition, the emission opening in the feed chamber can be at least flush with the opening in the cooking space wall. With a number of openings, hybrid forms can also be implemented. For instance, a u-shaped opening may be present in the feed chamber, while an opening in the form of a straight slot is realized in the cooking space wall. Both adjoining walls then accordingly support there a larger opening or cutout, where the corresponding and geometrically decisive resonantly excitable opening faces the other wall. Essentially an opening in the cooking space wall can therefore also be a resonantly excitable emission opening, if it can be galvanically connected to the microwave supply line.

In yet another embodiment, the feed chamber has a front wall which is formed by means of the cooking space wall and in which at least one resonantly excitable emission opening is present. Assembled here is therefore in particular a feed chamber which firstly opens toward the cooking space wall, wherein following assembly the associated cooking space wall is the single wall or wall region of the feed chamber which faces the cooking space or borders the cooking space. The cooking space wall then therefore represents the front wall of the housing of the feed chamber.

Moreover, in another embodiment, at least one emission opening is closed with a microwave-permeable material. An ingress of dirt originating from the cooking space can advantageously be prevented. An emission opening can also be traversed or interrupted by in each case at least one web made from a microwave-permeable material. A number of webs of an emission opening can be arranged in the form of a mesh, for instance.

Moreover, in another embodiment, an otherwise air-filled interior of the feed chamber is filled at least partially with an at least electrically insulating material. This advantageously increases the electrical dielectric strength. An at least electrically insulating material can be understood to mean an electrically insulating material or an electrically and thermally insulating material. Possible materials, with which the feed chamber can be filled, comprise e.g. glass wool or ceramic foam.

In yet another embodiment, a housing of the feed chamber additionally has air passage openings, which cannot be excited resonantly and which are advantageously impermeable to microwaves. The air passage openings can allow an air cooling or when arranged toward a fan path achieve an increase in pressure ("ventilated chamber"). The increase in pressure in the feed chamber can likewise reduce an ingress of vapor from the cooking space into the feed chamber or even entirely prevent it.

BRIEF DESCRIPTION OF THE DRAWINGS

The above-described properties, features and advantages of this invention and the manner in which these are achieved will become more clearly and easily intelligible in connection with the following schematic description of an exemplary embodiment, which is explained in more detail with reference to the drawings.

DETAILED DESCRIPTION OF EXEMPLARY EMBODIMENTS OF THE PRESENT INVENTION

Figure 1:
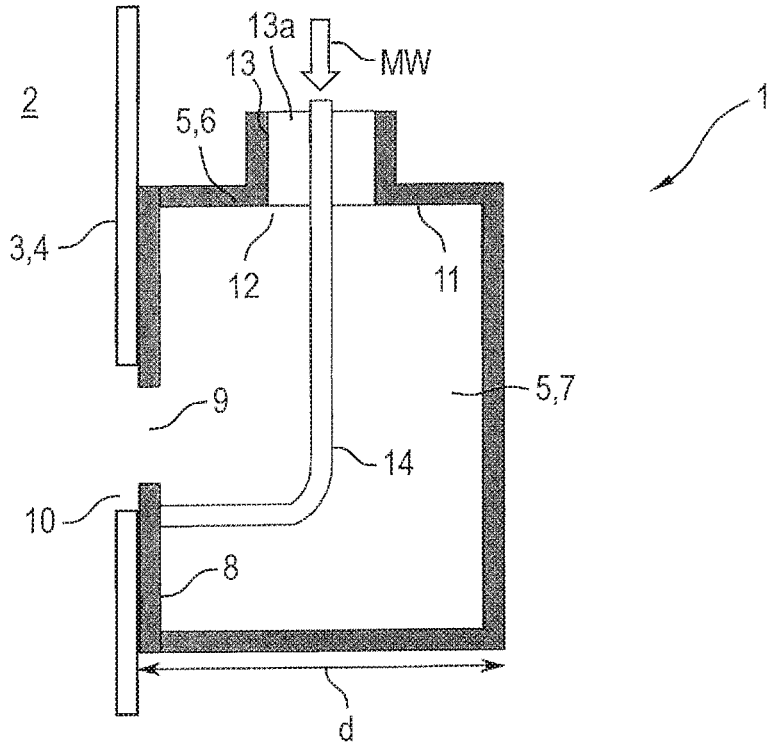
FIG. 1 shows a sectional representation in a side view of a cutout from a household cooking appliance having a feed chamber according to a first exemplary embodiment.

FIG. 1 shows a sectional representation in a side view of a cutout from a household cooking appliance in the form of a microwave appliance 1. The microwave appliance 1 has a, possibly also heatable, cooking space 2, which is restricted by a cooking space wall 3. A feed chamber 5 is fastened to an outside of a side wall 4 of the cooking space wall 3 as a component of a microwave apparatus. The feed chamber 5 has an interior 7 surrounded by an electrically conductive housing 6. In a front wall region (front wall 8) of the feed chamber 5 is a slot-shaped emission opening 9 which opens into the cooking space 2. The front wall 8 is therefore facing the cooking space 2 and lies in a planar manner on the side wall 4 of the cooking space wall 3. The side wall 4 likewise has an opening 10, which is larger than the emission opening 9 and releases this, in other words is not covered.

In a wall section ("ceiling" 11) which adjoins the front wall 8 and is vertical thereto is provided a further opening ("connection opening" 12) for connecting a microwave line. The microwave line is embodied here as a microwave coaxial cable 13, 14, which is inserted into the connection opening 12. Here an outer conductor 13 remains in the connection opening 12 and is connected galvanically hereto or to the ceiling 11, while an inner conductor 14 projects into the feed chamber 5 or into the associated interior 7. The inner conductor 13 is separated from the outer conductor 14 by means of a dielectric medium 13*a*, e.g. made from Teflon.

The inner conductor 14 is galvanically connected to a wall region of the feed chamber 5 which restricts the emission opening 9, by it being electrically connected to the front wall 8, e.g. by means of caulking, latching, screwing, welding etc., in the vicinity of the emission opening 9.

The inner conductor 14 runs starting from the connection opening 12 firstly parallel to the front wall 8 and in the process traverses the emission opening 9. The inner conductor 14 then bends at a right angle in the direction of the front wall 8. The inner conductor 14 then strikes the front wall 8 vertically.

The microwave coaxial cable 13, 14 can be impinged upon by microwaves MW, which can be generated by a microwave generator, e.g. a magnetron (not shown) as a further component of the microwave apparatus. The microwaves MW are routed from the inner conductor 14 to the front wall 8 and cause the emission opening 9 to be excited resonantly or oscillate resonantly. Subsequently, the emission opening 9 emits high-quality broadband microwaves into the cooking space. The emission opening 9 can also be considered to be a slot antenna. However, the emission opening 9 does not couple out microwaves which are in the interior 7 but is fed directly by means of the inner conductor 14. In other words, the feed chamber 5 is not a chamber which is resonant for the microwaves. As a result, a chamber height d can be kept particularly flat, as a result of which installation space can be spared noticeably.

Figure 2:
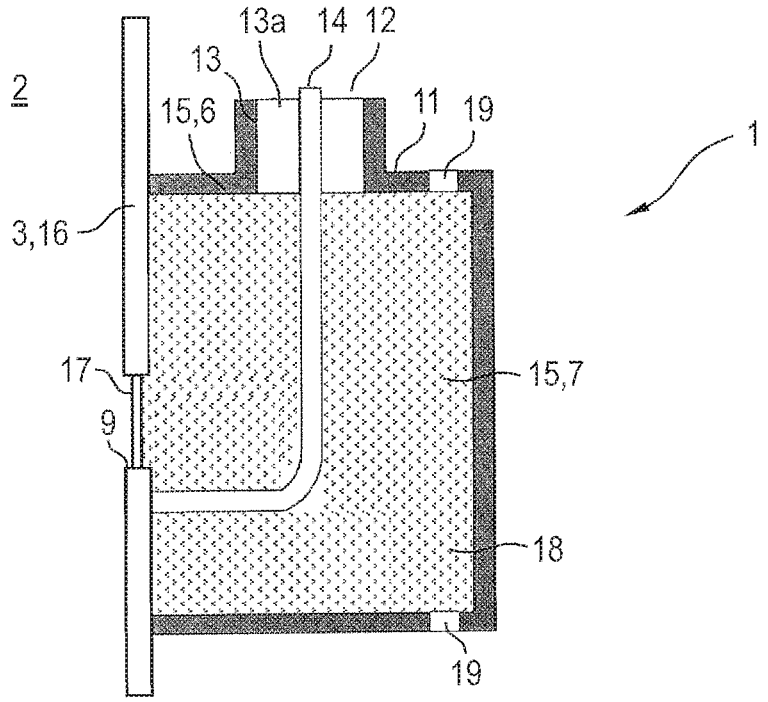
FIG. 2 shows a sectional representation in a side view of a cutout from a household cooking appliance having a feed chamber according to a second exemplary embodiment.

FIG. 2 shows a feed chamber 15, e.g. for use with the microwave appliance 1, as a sectional representation in the side view. The feed chamber 15 is designed similarly to the feed chamber 5 but has no front wall region which differs from an electrically conductive side wall 16 of the cooking space wall 3. Instead, the side wall 16 of the cooking space wall 3 represents the front wall 8 of the feed chamber 15. The emission opening 9 is located in the side wall 16. The feed chamber 15 can be positioned on the side 16 when assembled with a firstly open front side, for instance.

The emission opening 9 can be closed using a microwave-permeable material, e.g. with a microwave-permeable plate 17 or film.

Furthermore, the interior 7 of the feed chamber 15 can be filled with an electrically and thermally insulating material 18, e.g. with glass wool or ceramic foam.

The housing 6 of the feed chamber 15 can have additional air passage openings 19, which cannot be excited resonantly by the microwaves MW and are advantageously not permeable to the microwaves MW.

Figure 3:
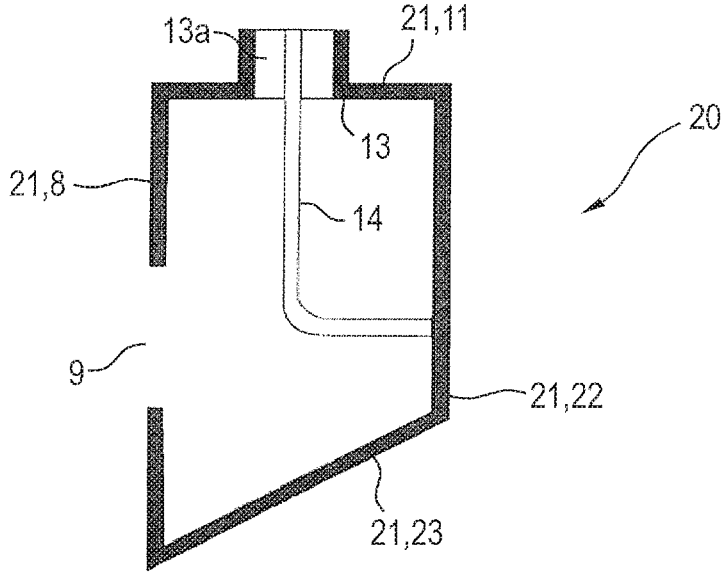
FIG. 3 shows a sectional representation in a side view of a feed chamber according to a third exemplary embodiment.

FIG. 3 shows a feed chamber 20 with an electrically conductive housing 21, as a sectional representation in the side view. The feed chamber 20 can be used with the microwave appliance 1, for instance. The feed chamber 20 differs from the feed chamber 5 in that the inner conductor 14 does not contact the front wall 8 of the housing 21 which faces the cooking space 2, but instead a wall region (rear wall 22) which faces away from the cooking space 2. Because the housing 21 is electrically conductive and the rear wall 22 is therefore electrically connected to the front side 8 by way of lateral wall region (see Fig.), the ceiling 11 and a base 23, the inner conductor 14 is also connected galvanically to the electrically conductive wall region (namely the front wall 8) of the feed chamber 20 which restricts the emission opening 9. The contact region of the inner conductor 14 with the rear wall 22 can be disposed opposite to the emission opening 9. The inner conductor 14 strikes the rear wall 22 at a right angle.

Moreover, conversely to the feed chamber 5 the feed chamber 20 has an oblique base 23.

Figure 4:
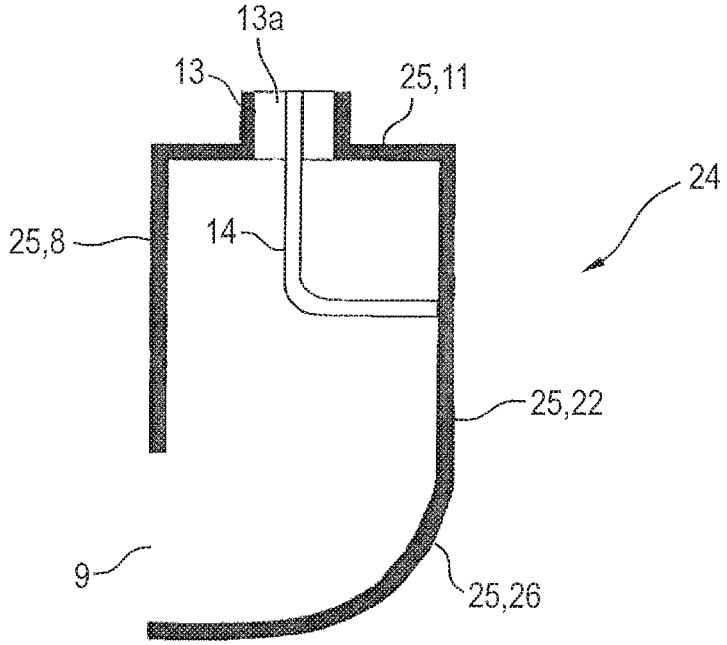
FIG. 4 shows a sectional representation in a side view of a feed chamber according to a fourth exemplary embodiment.

FIG. 4 shows a feed chamber 24 with an electrically conductive housing 25 as a sectional representation in the side view. The feed chamber 24 can also be used with the microwave appliance 1, for instance. In contrast to the feed chamber 20, the base 26 is embodied to be curved. The emission opening 9 is formed on a lower edge region of the front wall 8. The contact region of the inner conductor 14 with the housing 25 is further disposed on the rear wall 22.

Figure 5:
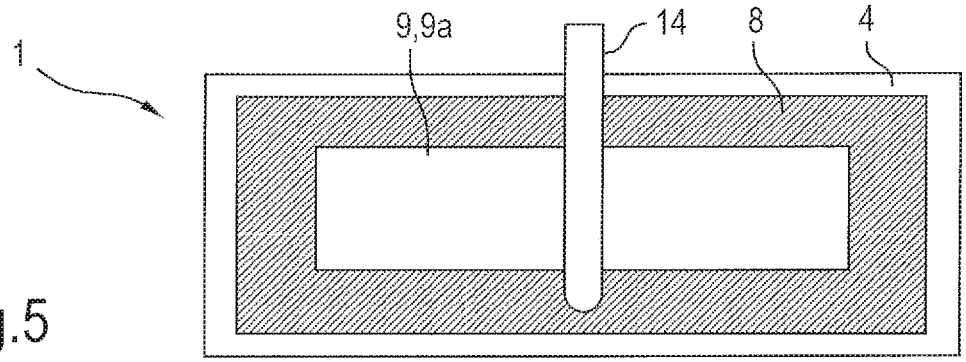
FIG. 5 shows a rear view of a cutout from a feed chamber in the region of a resonantly excitable opening.

FIG. 5 shows, in a rear view, a cutout from a feed chamber, e.g. the feed chamber 1, in the region of the resonantly excitable opening 9, 9*a*. The opening 9*a* is present here in the form of a straight slot. The inner conductor 14 traverses the opening 9*a*.

Figure 6:
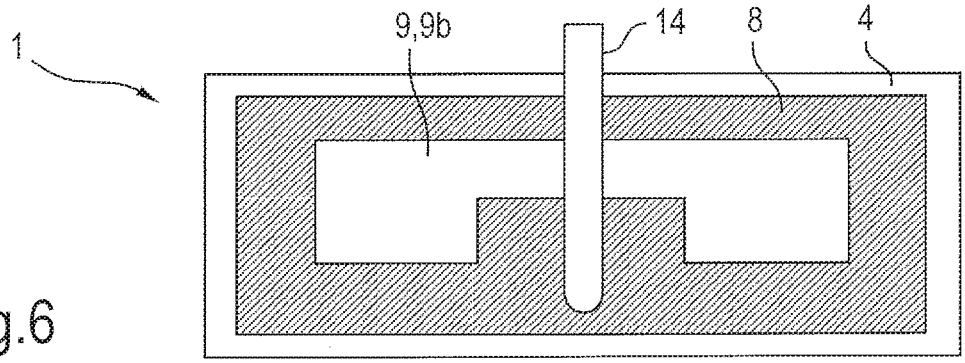
FIG. 6 shows a rear view of a cutout from a further feed chamber in the region of a resonantly excitable opening.

FIG. 6 shows, in a rear view, a cutout from a further feed chamber, e.g. the feed chamber 1, in the region of the resonantly excitable opening 9, 9*b*. The opening 9*b* is present here in the form of a u-shaped slot.

Figure 7:
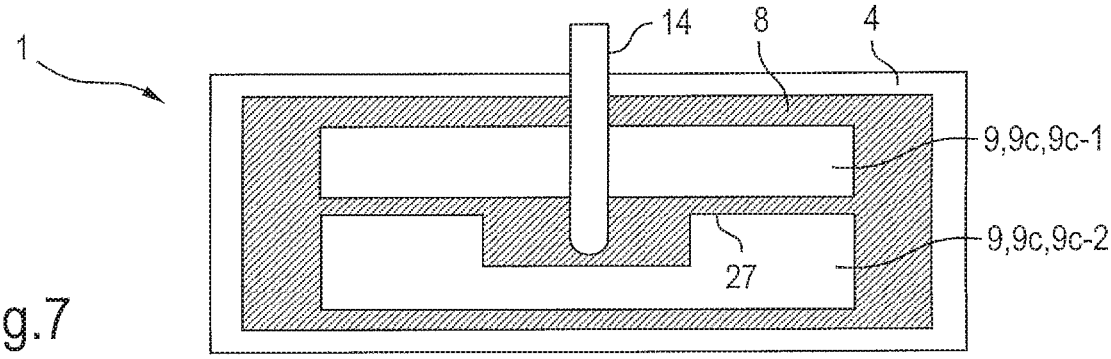
FIG. 7 shows a rear view of a cutout from another further feed chamber in the region of a resonantly excitable opening.

FIG. 7 shows, in a rear view, a cutout from a further feed chamber, e.g. the feed chamber 1, in the region of the resonantly excitable opening 9, 9*c*. The opening 9*c* is here in the form of a straight slot, which is divided by a web 27. The inner conductor 14 contacts the web 27. The web is widened on one side at its contact region. The web divides the opening 9*c* into a straight subregion 9*c*-1 and a u-shaped subregion 9*c*-2. The subregions 9*c*-1 and 9*c*-2 can each be excited resonantly by the microwaves MW and are used as slot antennas. In another view, the feed chamber 1 has two resonantly excitable, slot-shaped openings 9*c*-1 and 9*c*-2. The inner conductor 14 contacts the wall region between the two openings 9*c*-1 and 9*c*-2.

Naturally, the present invention is not restricted to the exemplary embodiment disclosed.

In general, "a", "an", etc. can be understood as singular or plural, in particular in the sense of "at least one" or "one or more", etc., provided this is not explicitly excluded, e.g. by the expression "exactly one", etc.

A numerical value can also include the given value as a typical tolerance range, provided this is not explicitly excluded.

The invention claimed is:

1. A household cooking appliance, comprising:

a cooking space; and a microwave apparatus configured to feed microwaves into the cooking space, said microwave apparatus including a feed chamber arranged outside of the cooking space and configured to open into the cooking space through an emission opening which is excitable by the microwaves, and a microwave line projecting into the feed chamber and connected galvanically to an electrically conductive wall region of the feed chamber which wall region restricts the emission opening, said feed chamber defining a chamber which is non-resonant for the microwaves.

2. The household cooking appliance of claim 1, wherein the emission opening is embodied in the shape of a slot.

3. The household cooking appliance of claim 1, wherein the emission opening is a u-shaped opening.

4. The household cooking appliance of claim 1, wherein the emission opening is a straight opening.

5. The household cooking appliance of claim 1, wherein the emission opening is configured to form two emission openings, which are separated from one another by a web, said microwave line contacting the web galvanically.

6. The household cooking appliance of claim 1, wherein the microwave line is an inner conductor of a coaxial microwave line.

7. The household cooking appliance of claim 1, wherein the wall region of the feed chamber faces the cooking space.

8. The household cooking appliance of claim 7, wherein the emission opening is introduced in the wall region, said wall region resting on an outside of a wall of the cooking space, said cooking space wall having an opening, which is flush with the emission opening.

9. The household cooking appliance of claim 1, wherein the microwave line is configured to traverse the emission opening.

10. The household cooking appliance of claim 1, wherein the microwave line contacts galvanically a wall region which does not face the cooking space.

11. The household cooking appliance of claim 1, wherein the electrically conductive wall region of the feed chamber is formed by a wall of the cooking space, said emission opening being present in the electrically conductive wall region of the feed chamber.

12. The household cooking appliance of claim 1, further comprising a microwave-permeable material configured to seal the emission opening.

13. The household cooking appliance of claim 1, further comprising an electrically insulating material filled in an interior of the feed chamber.

14. The household cooking appliance of claim 1, wherein the feed chamber includes a housing having an air passage opening.

* * * * *